US005950604A

United States Patent [19]

Inamijima

[11] Patent Number: 5,950,604

[45] Date of Patent: Sep. 14, 1999

[54] ENGINE, ENGINE MANUFACTURING METHOD AND ENGINE HEAT

[75] Inventor: Shunichi Inamijima, Yokohama, Japan

[73] Assignee: Nissan Motor Co., Ltd, Yokohama, Japan

[21] Appl. No.: 08/979,928

[22] Filed: Nov. 26, 1997

[30] Foreign Application Priority Data

Nov. 29, 1996 [JP] Japan ..... 8-319668

[51] Int. Cl.[6] ..... F02M 25/07

[52] U.S. Cl. ..... 123/568.11; 123/568.27; 123/568.29; 123/198 E

[58] Field of Search ..... 123/568.11, 568.27, 123/568.29, 143 C, 195 C, 195 A, 198 E, 568.12, 568.18, 568.26

[56] References Cited

U.S. PATENT DOCUMENTS

| | | | |
|---|---|---|---|
| 2,722,927 | 11/1955 | Cornelius | 123/568.27 |
| 3,782,348 | 1/1974 | Linder | 123/568.26 |
| 3,791,360 | 2/1974 | Rieger | 123/568.26 |
| 4,413,605 | 11/1983 | Leoni | 123/568.12 |
| 5,433,183 | 7/1995 | Vansnick | 123/568.11 |
| 5,494,255 | 2/1996 | Pearson et al. | 123/568.26 |
| 5,603,297 | 2/1997 | Wolf et al. | 123/195 C |
| 5,649,510 | 7/1997 | Linze | 123/198 E |
| 5,669,364 | 9/1997 | Everingham | 123/568.18 |

FOREIGN PATENT DOCUMENTS 7-42423 8/1995 Japan .

*Primary Examiner*—Willis R. Wolfe
*Attorney, Agent, or Firm*—Foley & Lardner

[57] ABSTRACT

A heat blocking member is fixed to a part of an engine in order to protect a signal wire or the like situated nearby from heat generated by the exhaust recirculation device. The exhaust recirculation device comprises an exhaust recirculation passage connecting an intake passage and an exhaust passage of the engine, a valve for opening and closing the exhaust recirculation passage and a drive mechanism for opening the valve. The valve is normally closed. By forming a specific part of the drive mechanism in a one-piece construction In with the heat blocking member, exhaust recirculation is prevented from taking place when the heat blocking member is not attached.

16 Claims, 3 Drawing Sheets

ENGINE, ENGINE MANUFACTURING METHOD AND ENGINE HEAT

The contents of Tokugan Hei 8-319668, with a filing date of Nov. 29, 1996 in Japan, are hereby incorporated by reference.

FIELD OF THE INVENTION

This invention relates to an engine, and in particular, to an engine in which a heat blocking member is installed.

BACKGROUND OF THE INVENTION

An exhaust gas recirculation device (EGR device) is known in which the combustion temperature of an air-fuel mixture in an engine is lowered in order to improve the exhaust gas composition by mixing part of the exhaust with the intake air.

This exhaust gas recirculation device comprises an EGR passage connecting an exhaust passage with an intake passage of the engine, an EGR control valve which is provided in the EGR passage for controlling an EGR flowrate, and an actuator which drives the EGR control valve by a negative pressure in the intake passage.

As high temperature exhaust gas circulates through the EGR passage and EGR control valve, they easily reach a high temperature. In this regard, Jikkai Hei 7-42423 published by the Japanese Patent Office in 1995 discloses providing a heat blocking member near the EGR passage and EGR control valve so that the heat produced by the EGR device does not affect parts located in the vicinity of the EGR device such as signal wires or hoses.

However, this heat blocking member or the like may be forgotten to be reinstalled after removing it for the repair of the engine or peripheral devices, and such a mistake could conceivably occur even in a manufacturing plant.

SUMMARY OF THE INVENTION

It is therefore an object of this invention to prevent an EGR device from operating when a heat blocking member is not installed.

In order to achieve the above object, this invention provides an engine comprising an intake passage, an exhaust passage, and an exhaust recirculation device. The exhaust recirculation device comprises an exhaust recirculation passage connecting the intake passage and the exhaust passage, a valve which is normally closed for opening and closing the exhaust recirculation passage, a drive mechanism for opening the valve, and a heat blocking member covering one part of the exhaust recirculation device, wherein a specific part of the drive mechanism is formed in a one-piece construction with the heat blocking member.

It is preferable that the heat blocking member is fixed to the engine such that the member can be removed.

If the engine comprises an intake manifold, it is preferable that the heat blocking member is fixed to the intake manifold.

If the drive mechanism comprises a negative pressure passage, it is preferable that a specific part of the negative pressure passage is formed in a one-piece construction with the heat blocking member.

If the negative pressure passage is formed of a pipe, it is preferable that the specific part of the pipe is fixed to the heat blocking member.

In this case, it is further preferable that a remaining part of the pipe is supported by the engine, and the specific part of the pipe is connected to the remaining part of the pipe via a rubber hose.

It is also preferable that the heat blocking member comprises a plate, and the specific part of the pipe is fixed to the plate by solder.

If the engine comprises a throttle chamber, it is preferable that a negative pressure in the negative pressure passage is led from the throttle chamber.

This invention also provides a method of manufacturing an engine which comprises an exhaust recirculation device comprising an exhaust recirculation passage, a valve which is normally closed for opening and closing the exhaust recirculation passage, a drive mechanism for opening the valve, and a heat blocking member covering a part of the exhaust recirculation device. The method comprises the steps of fixing the heat blocking member formed in a one-piece construction with a specific part of the drive mechanism, to a predetermined position of the engine, and connecting the specific part of the drive mechanism to a remaining part of the drive mechanism previously provided in the engine.

This invention also provides a heat blocking member for blocking heat generatedby an exhaust recirculation device comprising an exhaust recirculation passage connecting an intake passage and an exhaust passage of an engine, a valve which is normally closed for opening and closing the exhaust recirculation passage, and a drive mechanism for opening the valve, wherein a specific part of the drive mechanism is formed in a one-piece construction with the heat blocking member.

It is preferable that the heat blocking member is fixed to the engine such that the member may be removed.

If the engine comprises an intake manifold, it is preferable that the heat blocking member is fixed to the intake manifold.

If the drive mechanism comprises a negative pressure passage, it is preferable that a specific part of the negative pressure passage is formed in a one-piece construction with the heat blocking member.

If the negative pressure passage comprises a pipe, it is preferable that a specific part of the pipe is fixed to the heat blocking member.

In this case, it is further preferable that a remaining part of the pipe is supported by the engine, and the specific part of the pipe is connected to the remaining part of the pipe via a rubber hose.

It is also preferable that the heat blocking member comprises a plate, and a specific part of the pipe is fixed to the plate by solder.

The details as well as other features and advantages of this invention are set forth in the remainder of the specification and are shown in the accompanying drawings.

DESCRIPTION OF THE PREFERRED EMBODIMENTS

Figure 4:
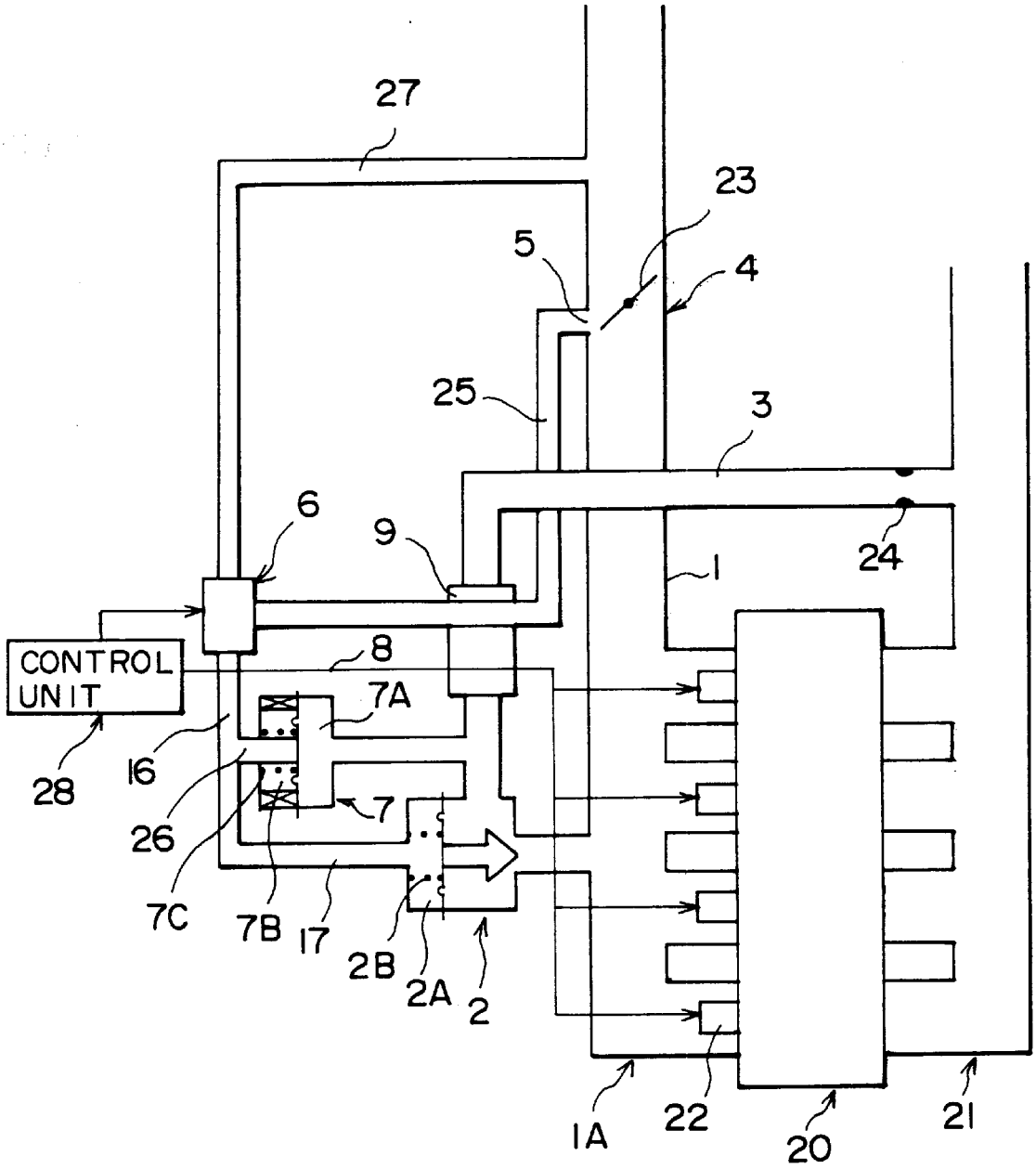
FIG. 4 is a schematic diagram of the EGR device.

Referring to FIG. 4 of the drawings, an engine 20 comprises an intake passage 1 and an exhaust passage 21. Fuel injection valves 22 for injecting fuel into intake ports are provided in an intake manifold 1A of the intake passage 1. A throttle 23 is provided in a throttle chamber 4 formed in an upstream part of the intake passage 1.

The exhaust passage 21 and intake passage 1 are connected by an EGR passage 3. An orifice 24 is provided in the EGR passage 3.

An EGR control valve 2 comprising a diaphragm valve which is normally closed is provided downstream of the orifice 24.

The EGR control valve 2 comprises a negative pressure chamber 2A, and negative pressure in the intake passage 1 is led to the negative pressure chamber 2A via negative pressure passages 16, 17 and 25. The negative pressure passage 25 is connected to a negative pressure outlet 5 formed in the throttle chamber 4 of the intake passage 1. The EGR control valve 2 is pushed in the closing direction by a spring 2B, and the EGR passage 3 opens against the force of the spring 2B according to increase of negative pressure in the negative pressure chamber 2A.

One end of an atmospheric air inlet passage 26 is connected to connecting parts of the negative pressure passages 16, 17. Atmospheric air is introduced into the atmospheric inlet passage 26 via a negative pressure control valve 7 which is of the back pressure transducer type. The negative pressure control valve 7 comprises an exhaust pressure chamber 7A and atmospheric air chamber 7B partitioned by a diaphragm. The diaphragm is pushed in the opening direction by a spring 7C. The exhaust pressure chamber 7A is connected to the EGR passage 3, and the exhaust pressure of the engine 20 acts on the diaphragm in the opposite direction to the spring 7C. As a result, the negative pressure control valve 7 opens as the exhaust pressure of the exhaust pressure chamber 7A falls, and the negative pressure of the negative pressure passage 17 is diluted by introducing the atmospheric pressure in the atmospheric air chamber 7B into the negative pressure passage 17 via the atmospheric air inlet passage 26.

For example, when a predetermined negative pressure is introduced into the negative pressure chamber 2A of the EGR control valve 2, the EGR control valve 2 lifts and EGR is performed. However, when the pressure of the EGR passage 3 falls, as the negative pressure control valve 7 opens so that atmospheric air is introduced into the negative pressure passage 17, the EGR control valve 2 closes. When the EGR control valve 2 closes, the pressure in the EGR passage 3 rises, and * as introduction of atmospheric air from the negative pressure control valve 7 to the negative pressure passage 17 stops, the EGR control valve 2 opens. Recirculation of exhaust gas to the intake passage 1 is performed by repeating this sequence of operations.

The negative pressure passages 16, 25 are connected via an EGR cut valve 6 for forcibly stopping exhaust recirculation. The EGR cut valve 6 comprises a three-way changeover solenoid valve. When the solenoid valve is OFF, the negative pressure passages 16, 25 are connected. When the valve is ON, the negative pressure passage 25 is blocked, and atmospheric air is introduced from the upstream part of the intake passage 1 to the negative pressure passage 16 via an atmospheric air passage 27.

The EGR cut valve 6 is used for stopping recirculation of exhaust when the engine is cold or running idle.

The opening and closing of the EGR cut valve 6, together with the fuel injection amount and injection timing of the fuel injection valves 22, are controlled by signals output from a control unit 28 comprising a microcomputer.

Figure 1:
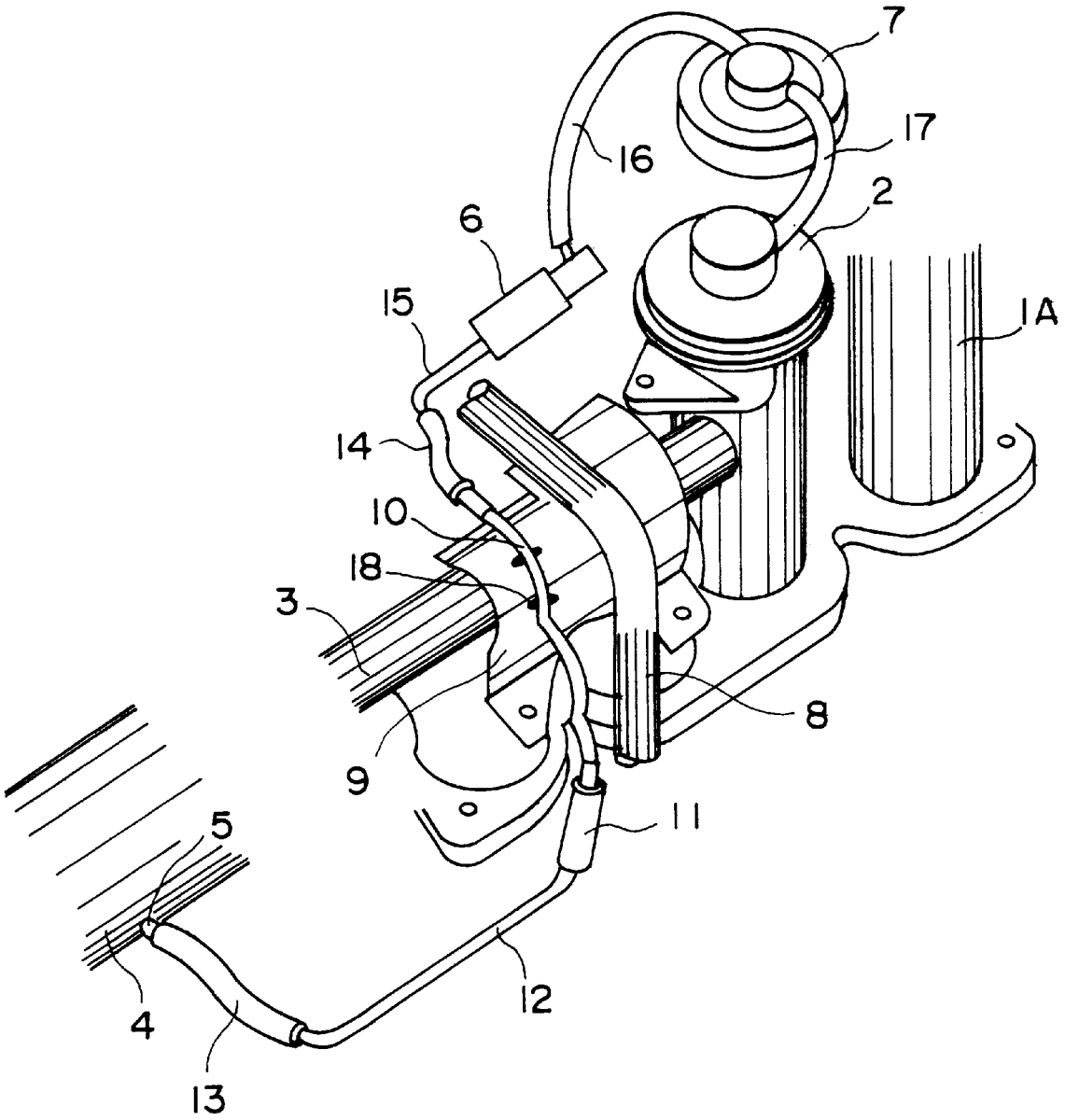
FIG. 1 is a perspective view of an EGR device comprising a heat blocking member according to this invention.

Next, referring to FIG. 1 of the drawings, signal wires 8 leading from the control unit 28 to the fuel injection valves 22 are disposed above the EGR passage 3. A heat blocking member 9 comprising an iron plate is provided between the EGR passage 3 and the signal wires 8.

Figure 2:
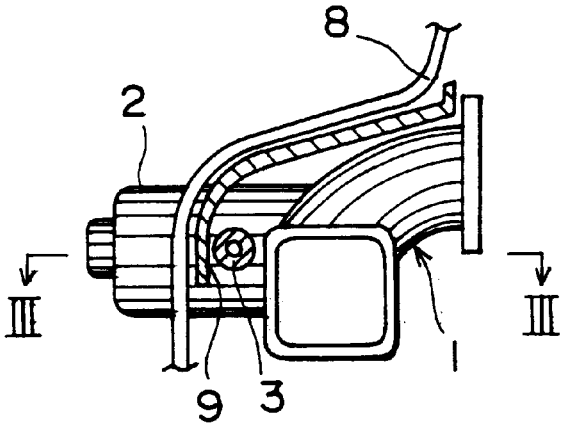
FIG. 2 is a vertical cross sectional view of essential parts of the EGR device including the heat blocking member.
Figure 3:
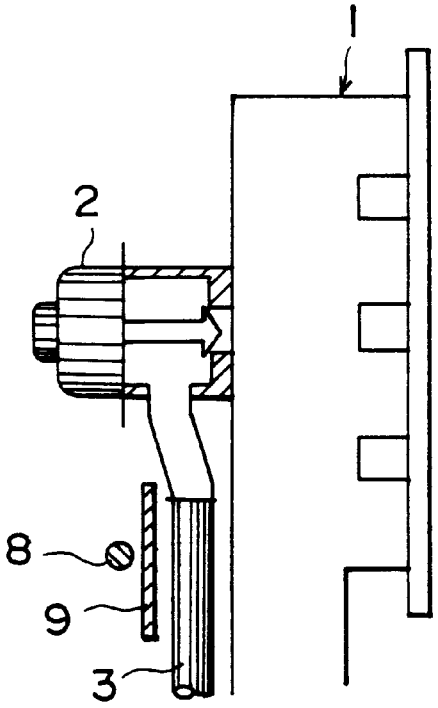
FIG. 3 is a horizontal cross sectional view of the EGR device taken along a line III—III in FIG. 2.

The heat blocking member 9 is fixed to the intake manifold 1A, and it curves so that it covers the EGR passage 3. As shown in FIGS. 2 and 3, the signal wires 8 are disposed along an outer circumference of the heat blocking member 9.

A pipe 10 forming a part of the negative pressure passage 25 is fixed to an outer circumferential part of the heat blocking member 9 by solder 18.

One end of the pipe 10 is connected to another pipe 12 via a rubber hose 11. The pipe 12 is connected to the negative pressure outlet 5 formed in the throttle chamber 4 via a rubber hose 13. The other end of the pipe 10 is connected to a pipe 15 extending from the EGR cut valve 6 via a rubber hose 14.

The negative pressure passage 25 comprises the rubber hoses 11, 13, 14 and the pipes 10, 12, 15.

The heat blocking member 9, which is therefore formed in a one-piece construction with the pipe 10 due to the solder 18, shields the signal wires 8 from the heat of the EGR passage 3 when the engine is running. Also, when the heat blocking member 9 is removed, it is removed together with the pipe 10. In this state, part of the negative pressure passage 25 is missing. Therefore, unless the heat blocking member 9 is not reinstalled in its predetermined position in the intake manifold 1A, negative pressure is not supplied to the negative pressure chamber 2A of the EGR control valve 2, and the EGR passage 3 remains closed.

In other words, if it is forgotten to instal the heat blocking member 9 in a manufacturing plant or during repair work, exhaust does not circulate through the EGR passage 3 irrespective of the running conditions of the engine 20.

Consequently, the EGR passage 3 does not reach a high temperature, and the signal wires 8 are not affected by the high temperature of the EGR passage 3 even if the heat blocking member 9 is missing.

In this case, exhaust gas recirculation is not performed regardless of whether an EGR command signal is sent from the control unit to the EGR cut valve 6. If a high temperature sensor is provided in the EGR passage 3 downstream of the EGR control valve 2, the driver may be alerted that there is an error, e.g. by the lighting of a warning lamp.

This lamp lights when the control unit 28 determines that there is a problem in the EGR device, due to the fact that the temperature in the EGR passage 3 does not rise even when an EGR command signal was output.

It is desirable that the pipe 10 fixed to the heat blocking member 9 is set to a predetermined length or longer so that the rubber hoses 11 and 14 cannot be directly connected.

In the aforesaid embodiment, a part of the negative pressure passage 25 of the EGR control valve 2 was formed in a one-piece construction with the heat blocking member 9, but when the EGR control valve is driven for example by a solenoid, part of the solenoid energizing circuit may be formed in a one-piece construction with the heat blocking member 9. In this case, a lead wire having joining connectors at both ends is fixed to the heat blocking member 9 and the solenoid energizing circuit is thereby not established when the lead wire is not present.

When the EGR control valve 2 is driven by a hydraulic circuit or a mechanical link, the object of this invention may be realized by forming part of the circuit or link in a one-piece construction with the heat blocking member 9.

Instead of fixing the pipe 10 to the heat blocking member 9 by soldering, the heat blocking member 9 may be formed of thick plate, the inner side of this plate forming a part of the negative pressure passage 25. Alternatively, the heat blocking member 9 may be formed by joining two plates together, each plate having a groove, and the space formed by the grooves forming a part of the negative pressure passage 25.

In the above embodiment, the signal wires of the fuel injection valves were protected from high temperature, but this invention is also effective in protecting other components such as fuel hoses or cooling water hoses.

The embodiments of this invention in which an exclusive property or privilege is claimed are defined as follows:

1. An engine comprising:

an intake passage, an exhaust passage, and an exhaust recirculation device comprising the following components:

an exhaust recirculation passage connecting said intake passage and said exhaust passage, a valve which is normally closed for opening and closing said exhaust recirculation passage, a drive mechanism for opening said valve, and a heat blocking member covering one part of said exhaust recirculation device, a specific part of said drive mechanism being formed in a one-piece construction with said heat blocking member.

2. An engine as defined in claim 1, wherein said heat blocking member is fixed to said engine such that said member can be removed.

3. An engine as defined in claim 2, wherein said engine comprises an intake manifold, and said heat blocking member is fixed to said intake manifold.

4. An engine as defined in claim 1, wherein said drive mechanism comprises a negative pressure passage, and a specific part of said negative pressure passage is formed in a one-piece construction with said heat blocking member.

5. An engine as defined in claim 4, wherein said engine comprises a throttle chamber, and a negative pressure in said negative pressure passage is led from said throttle chamber.

6. An engine as defined in claim 4, wherein said negative pressure passage is formed of a pipe, and said specific part of said pipe is fixed to said heat blocking member.

7. An engine as defined in claim 6, wherein a remaining part of said pipe is supported by said engine, and said specific part of said pipe is connected to said remaining part of said pipe via a rubber hose.

8. An engine as defined in claim 6, wherein said heat blocking member comprises a plate, and said specific part of said pipe is fixed to said plate by solder.

9. A method of manufacturing an engine, said engine comprising an exhaust recirculation device comprising an exhaust recirculation passage, a valve which is normally closed for opening and closing said exhaust recirculation passage, a drive mechanism for opening said valve, and a heat blocking member covering a part of said exhaust recirculation device, said method comprising the steps of:

fixing said heat blocking member formed in a one-piece construction with a specific part of said drive mechanism, to a predetermined position of said engine, and connecting said specific part of said drive mechanism to a remaining part of said drive mechanism previously provided in said engine.

10. A heat blocking member for blocking heat generated by an exhaust recirculation device, said device comprising an exhaust recirculation passage connecting an intake passage and an exhaust passage of an engine, a valve for opening and closing said exhaust recirculation passage, said valve being normally closed, and a drive mechanism for opening said valve, wherein a specific part of said drive mechanism is formed in a one-piece construction with said heat blocking member.

11. A heat blocking member as defined in claim 10, wherein said heat blocking member is fixed to said engine such that said member may be removed.

12. A heat blocking member as defined in claim 10, wherein said engine comprises an intake manifold, and said heat blocking member is fixed to said intake manifold.

13. A heat blocking member as defined in claim 10, wherein said drive mechanism comprises a negative pressure passage, and a specific part of said negative pressure passage is formed in a one-piece construction with said heat blocking member.

14. A heat blocking member as defined in claim 13, wherein said negative pressure passage comprises a pipe, and a specific part of said pipe is fixed to said heat blocking member.

15. A heat blocking member as defined in claim 14, wherein a remaining part of said pipe is supported by said engine, and said specific part of said pipe is connected to said remaining part of said pipe via a rubber hose.

16. A heat blocking member as defined in claim 14, wherein said heat blocking member comprises a plate, and a specific part of said pipe is fixed to said plate by solder.

* * * * *